US009123464B2

(12) United States Patent
Von Bloh et al.

(10) Patent No.: US 9,123,464 B2
(45) Date of Patent: Sep. 1, 2015

(54) TRANSFORMER WITH ON-LOAD TAP CHANGER

(71) Applicants: Jochen Von Bloh, Aachen (DE); Volker Karrer, Regensburg (DE); Dieter Dohnal, Lappersdorf (DE); Karsten Viereck, Regensburg (DE)

(72) Inventors: Jochen Von Bloh, Aachen (DE); Volker Karrer, Regensburg (DE); Dieter Dohnal, Lappersdorf (DE); Karsten Viereck, Regensburg (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 14/373,043

(22) PCT Filed: Jan. 15, 2013

(86) PCT No.: PCT/EP2013/050611

§ 371 (c)(1),
(2) Date: Jul. 18, 2014

(87) PCT Pub. No.: WO2013/120642

PCT Pub. Date: Aug. 22, 2013

(65) Prior Publication Data

US 2014/0375407 A1 Dec. 25, 2014

(30) Foreign Application Priority Data

Feb. 13, 2012 (DE) ..... 10 2012 202 105

(51) Int. Cl.
*H01F 29/02* (2006.01)
*H01F 5/00* (2006.01)
*H01F 29/04* (2006.01)
*H01H 9/00* (2006.01)

(52) U.S. Cl.
CPC ..... *H01F 29/02* (2013.01); *H01F 5/00* (2013.01); *H01F 29/04* (2013.01); *H01H 9/0011* (2013.01); *H01H 9/0016* (2013.01)

(58) Field of Classification Search
CPC ..... H01F 5/00; H01F 27/00–27/30
USPC ..... 336/107, 200, 232, 180–186
See application file for complete search history.

(56) References Cited

U.S. PATENT DOCUMENTS

| | | | | |
|---|---|---|---|---|
| 3,581,188 | A * | 5/1971 | Watanabe et al. | 323/340 |
| 3,668,511 | A | 6/1972 | Lewis | |
| 4,207,445 | A * | 6/1980 | Hammar | 200/11 TC |
| 6,856,122 | B2 * | 2/2005 | Dohnal et al. | 323/258 |
| 8,576,038 | B2 | 11/2013 | Kraemer | |

FOREIGN PATENT DOCUMENTS

| | | |
|---|---|---|
| EP | 0294653 A | 12/1988 |
| GB | 2424756 A | 10/2006 |

* cited by examiner

*Primary Examiner* — Tuyen Nguyen
(74) *Attorney, Agent, or Firm* — Andrew Wilford

(57) ABSTRACT

The invention relates to a transformer with a tap changer, wherein optionally the primary or secondary side can be regulated by the tap changer, and wherein, on the side of the transformer to be regulated, a main winding and at least one regulating winding, which is connectable by the tap changer, are provided. According to the invention, the main winding is divided into two main winding parts, and the at least one regulating winding and the tap changer (3) connecting the regulating winding are arranged electrically between the two main winding parts (1, 2).

4 Claims, 2 Drawing Sheets

| $U_{ST}$ | W1 | W2 | W3 |
|---|---|---|---|
| | | = 3W1 | = 6 W1 |
| N | o | o | o |
| 1 | + | o | o |
| 2 | - | + | o |
| 2 | - | - | + |
| 3 | o | + | o |
| 3 | o | - | + |
| 4 | + | + | o |
| 4 | + | - | + |
| 5 | - | o | + |
| 6 | o | o | + |
| 7 | + | o | + |
| 8 | - | + | + |
| 9 | o | + | + |
| 10 | + | + | + |

$\Sigma$ = 21 steps

TRANSFORMER WITH ON-LOAD TAP CHANGER

CROSS REFERENCE TO RELATED APPLICATIONS

This application is the US-national stage of PCT application PCT/EP2013/050611 filed 15 Jan. 2013 and claiming the priority of German patent application 102012202105.1 itself filed 13 Feb. 2012.

FIELD OF THE INVENTION

The invention relates to a transformer with a tap changer for uninterrupted switching between parts of a regulating winding of the transformer.

BACKGROUND OF THE INVENTION

Tap changers for uninterrupted switching between winding taps of a tapped transformer have been known from the prior art for many years. The according tapped transformers to be regulated comprise a stepped regulating winding on the primary or also on the secondary side. The winding on the transformer side to be regulated consists altogether of one fixed part, which is the main winding, and the actual regulating winding that possesses a plurality of winding taps. This is explained in detail, for instance in the publication from the year 2000, "Axel Kramer: On-Load Tap-Changers for Power Transformers".

It is thus an established state of the art that the tapped transformer to be regulated comprises, on the transformer side to be regulated, a main winding and a stepped regulating winding connected in series thereto.

While earlier tap devices comprised mechanical switching components for switching between the individual winding taps of the regulating winding, vacuum switching components have been in place for a number of years now. More recently, semiconductor switching components for uninterrupted switching between such winding taps have also been proposed. Such semiconductor switching components possess numerous advantages, switching is possible without mechanical components; however they are relatively sensitive to overvoltages. In the prior art, such semiconductor switching components are invariably subject to high stress under lightning voltage exposure when testing the transformer and in the instance of transients in the network (e.g. when switching SF6-/vacuum power switches).

OBJECT OF THE INVENTION

The object of the invention is to provide a transformer with a tap changer in which the electrical stress of the semiconductor switching components used in the tap changer is minimized.

SUMMARY OF THE INVENTION

This object is attained by the invention based on the general idea of dividing the main winding, which is a unitary piece according to the prior art, into two identical winding parts on the transformer side to be regulated and of providing, between the winding parts, the regulating winding and thereon the appropriate tap changer.

This invention offers numerous advantages over the prior art. To begin with, it is no longer possible to expose the semiconductor switching components to the full amplitude of the lightning voltage wave, as the impedance of the half main winding is connected upstream. With the quasi upstream part of the main winding additionally absorbing a part of the energy of the lightning voltage wave, the protective circuit of the switching components can also be made to smaller dimensions, thus saving space and costs. Furthermore, it is also possible to deploy semiconductor switching components with a lower blocking/reverse voltage, as these have to be dimensioned primarily according to the lightning voltage stress rather than according to the power frequency withstand voltage.

With the upstream part of the divided main winding working, according to the invention, as a throttle for fast transients on the power line, the semiconductor switching components in this case are also not exposed to the full amplitude and slew rate because the individual winding parts have the dampening effect of a throttle connected upstream. For the divided main winding, it is particularly advantageous if the winding is designed symmetrically so as to minimize the force action in the case of a short circuit. Advantageously, the production of the two parts of the divided main winding according to the invention can be segmented into individual layers.

BRIEF DESCRIPTION OF THE DRAWING

In the following, the invention will be illustrated in more detail by drawings. The figures show.

SPECIFIC DESCRIPTION OF THE INVENTION

Figure 1:
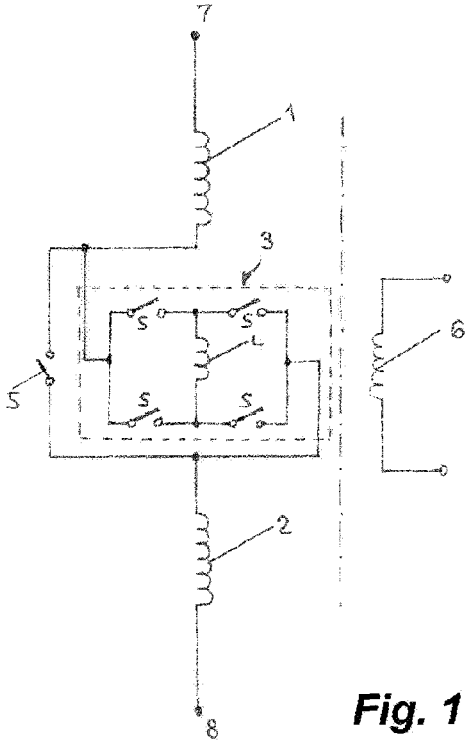
FIG. 1 a first embodiment of a transformer according to the invention with a tap-changing device.

FIG. 1 shows a transformer in a first embodiment of the invention whose primary and secondary sides are separated from each other by a schematically indicated dash-dot line. The primary side to be regulated is shown on the left side of the illustration. According to the invention, a divided main winding consisting of the two identical main winding parts 1, 2 is provided. Arranged in between is a tap changer 3 shown schematically by a dashed line. In the simplest instance represented here, the tap changer 3 comprises a regulating winding 4 surrounded by switching components S in the form of a bridge. It is possible to employ, for instance, anti-parallel thyristor pairs, IGBTs, or similar semiconductor switching components for the switching components S. In this simplest instance of the invention, the regulating winding 4 can be connected or disconnected. Also shown here is a switch 5, a so-called black start switch that ensures that the transformer can continue operate even in the instance of the regulator or the semiconductor switching components failing. The right-hand side indicates the secondary winding 6. The numerals 7 and 8 denote the beginning and the end of the entire winding structure on the is primary side.

Figure 2:
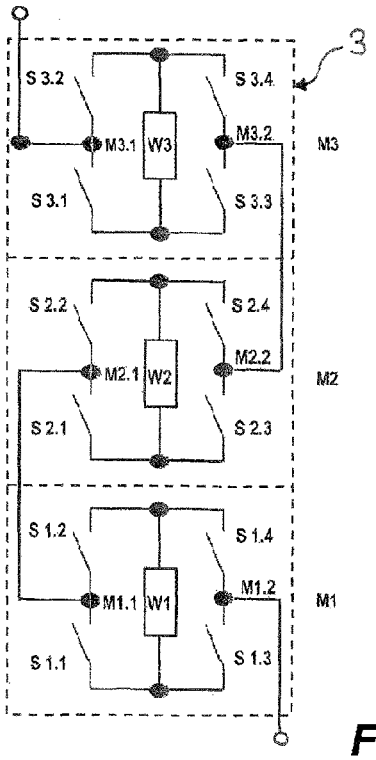
FIG. 2 a further embodiment of the invention.

FIG. 2 shows an advanced embodiment of the invention. Here, the tap changer 3 comprises several parts of a regulating winding W1, W2, W3. The tap changer 3 in this instance comprises three individual modules M1, M2, M3. The first module M1 comprises the first partial winding W1 and on both sides thereof two bypass paths, each of which comprises a series connection formed by two respective semiconductor switching components S1.1 and S1.2 or S1.3 and S1.4. Provided between the two serially connected switching components are respective center taps M1.1 and M1.2. Here and in the following figures, the individual semiconductor switching components are only schematically illustrated as simple switches. In practice, they comprise thyristor pairs, IGBTs or other semiconductor switching components that are parallel connected. They can also each comprise a series connection or a parallel connection of a plurality of such individual semiconductor switching components. One of the center taps M1.2 is electrically connected to the main winding part 2. The other center tap M1.1 is connected to a center tap M2.1 of the second module M2. This second module M2 is identically constructed, and it also comprises a partial winding W2 and the two series connections, each formed by two respective semiconductor switching components S2.1 and S2.2 or S2.3 and S2.4. Again, a respective center tap M2.1 and M2.2 is provided between the two series connections. The connection of the one center tap M2.1 to the first module M1 has already been explained above; the second center tap M2.2 in turn is connected to a center tap M3.2 of a third module M3. This third module M3 is, again, identically constructed. It also comprises a partial winding W3 and the two series connections formed by respective semiconductor switching components S3.1 and S3.2 or S3.3 and S3.4, as well as the center taps M3.1 and M3.2 positioned in between. The as yet not mentioned center tap M3.1 of the third and, in this instance, last module M3 is electrically connected to the main winding part 1.

The in this instance three modules M1 . . . M3 described here only differ in the dimensions of the respective partial windings W1 . . . W3. The partial winding W2 in the second module M2 here comprises triple the number of turns of the partial winding W1 in the first module M1. The partial winding W3 in the third module M3 here comprises sixfold the number of turns of the partial winding W1 in the first module M1.

Figures 3, 4:
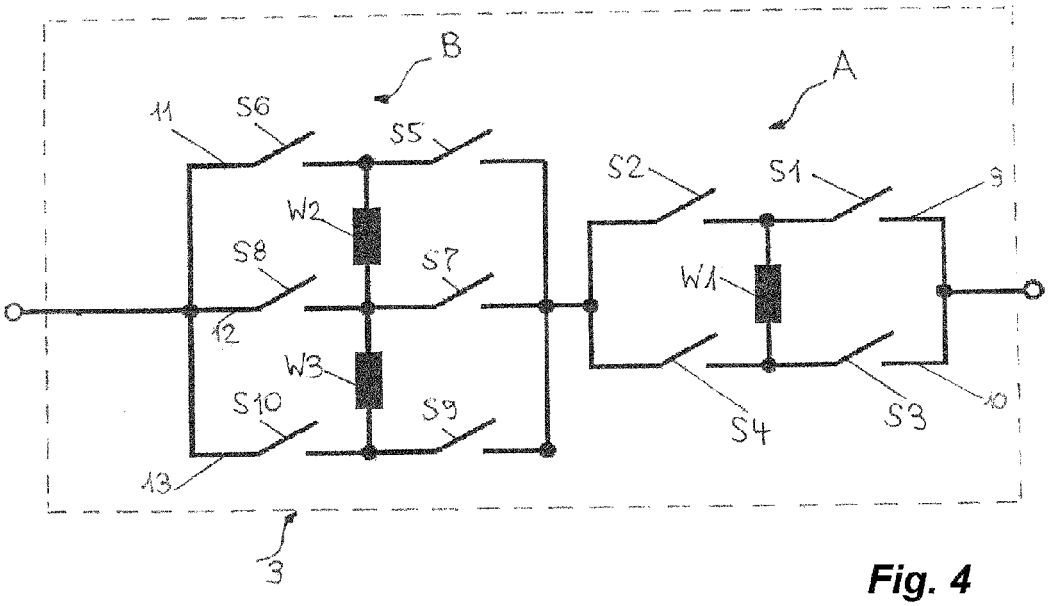
FIG. 3 a table of the achievable voltage levels for the embodiment according to FIG. 2.
FIG. 4 a third embodiment of the invention.

FIG. 3 shows a table of the connections for the tap changer according to the invention as shown in FIG. 2. The symbol "0" means that the corresponding partial winding is not switched on, i.e. it is bypassed. The symbol "Y" means that the corresponding partial winding is connected in the same sense as the high-voltage winding 2. The symbol "-", finally, means that the corresponding partial winding is connected in the reverse sense to the high-voltage winding 2. The table of connections shows the ten voltage levels that result from adding further partial voltages to the step voltage of the high-voltage winding 2. These partial voltages result from the different possibilities for same sense connection, reverse sense connection, or bypass of the individual winding parts W1 . . . W3. It can be seen that it is possible to produce certain voltage levels redundantly, i.e. by various switching statuses. It is also possible, but not shown in the table, to subtract accordingly stepped partial voltages in the other direction from the voltage in the high-voltage winding 2. As a result, there are a total of twenty-one possible voltage levels for this embodiment. In the middle position, here designated with N, is the tap changer. The main winding parts 1 and 2 are then directly connected to each other. The same sense or reverse sense connecting or bypassing of the individual winding parts W1 . . . W3 as explained above is effected by the according connection of the semiconductor switching components S1.1 . . . S3.4.

FIG. 4 shows a further embodiment of the invention. The tap changer 3 illustrated here is arranged between the main winding part 1 and the main winding part 2. The tap changer 3 has two serially connected switching assembly groups A and B. The first switching assembly group A in turn possesses a parallel connection formed by the two branches 9 and 10. In the first branch 9, two semiconductor switching units S1, S2 are provided connected in series to each other. In the parallel second branch 10, two further semiconductor switching units S3, S4 are provided connected in series to each other. Arranged between the two serially connected semiconductor switching units S1, S2 in the first branch 9 and the two serially connected semiconductor switching units S3, S4 in the second branch 10 is a first partial winding W1 of the regulating winding.

The second switching assembly group B possesses a parallel connection formed by three branches 11, 12, and 13. In the third branch 11, two semiconductor switching units S5, S6 are provided connected in series to each other, in the fourth branch 12, two semiconductor switching units S7, S8 are provided connected in series to each other, and in the fifth branch 13, two semiconductor switching units S9, S10 are provided connected in series to each other. Arranged between the two serially connected semiconductor switching units S5, S6 in the third branch 11 and the two serially connected semiconductor switching units S7, S8 in the fourth branch 12 is a second partial winding W2 of the regulating winding, and arranged between the two serially connected semiconductor switching units S7, S8 in the fourth branch 12 and the two serially connected semiconductor switching units S9, S10 in the fifth branch 13 is a third partial winding W3. In this embodiment, the second switching assembly group B is electrically connected to the main winding part 2.

Many different embodiments of the tap changer 3 with a most varied number of partial windings to be regulated and a wide variety of connections established by semiconductor switching components are possible within the scope of the invention. What is important for all these embodiments is solely that the appropriate switching device 3 is provided on the side of the transformer to be regulated between the two main winding parts 1,2 of the main winding that is divided according to the invention.

The invention claimed is:

1. A transformer with a tap changer wherein
- the transformer comprises a primary side and a secondary side,
- one of sides can be regulated by the tap changer and has one main winding and at least one regulating winding connectable by the tap changer,
- the main winding is divided into two main winding parts,
- the at least one regulating winding and the tap changer connecting the regulating winding are arranged electrically between the two main winding parts,
- the tap changer comprises first and second modules that each comprise one respective partial winding of the regulating winding and on both sides thereof two respective bypass paths,
- each bypass path comprises one series connection of two respective semiconductor switching components,
- one center tap is provided between the serially connected switching components of each bypass path,
- the partial windings possess different numbers of turns,
- one of the two center taps of each module is connected to a center tap of the adjacent module, and
- the other center tap of the first module is electrically connected to the one main winding part, and the other center tap of the second module is electrically connected to the other main winding part.

2. A transformer with a tap changer wherein
- the transformer comprises a primary side and a secondary side,
- one of the sides can be regulated by the tap changer and has one main winding and at least one regulating winding connectable by the tap changer, the main winding is divided into two main winding parts, and the at least one regulating winding and the tap changer connecting the regulating winding are arranged electrically between the two main winding parts.

the tap changer comprises first and second serially connected switching assembly groups the first switching assembly group in turn one parallel connection formed by first and second branches, the first branch has two semiconductor switching units connected in series to each other the second branch has two further semiconductor switching units connected in series to each other, the first regulating winding has a first partial winding connected between the two serially connected semiconductor switching units in the first branch and the two serially connected semiconductor switching units in the second branch, the second switching assembly group has a parallel connection formed by third, fourth, and fifth branches, the third branch has two semiconductor switching units connected in series to each other in the third branch, the fourth branch has two semiconductor switching units are provided connected in series to each other, and the fifth branch has two semiconductor switching units are connected in series to each other, the regulating winding has a second partial winding between the two serially connected semiconductor switching units in the third branch and the two serially connected semiconductor switching units in the fourth branch, and a third partial winding between the two serially connected semiconductor switching units in the fourth branch and the two serially connected semiconductor switching units in the fifth branch, and each one of the two switching assembly groups is electrically connected to a respective one of the two main winding parts.

3. The transformer with a tap changer according to claim 1, further comprising:

a mechanical contact that can bypass the tap changer and establish a direct electrical connection between the two main winding parts.

4. The transformer with a tap changer according to claim 2, further comprising:

a mechanical contact that can bypass the tap changer and establish a direct electrical connection between the two main winding parts.

* * * * *